US010864532B2

(12) United States Patent
Lin et al.

(10) Patent No.: US 10,864,532 B2
(45) Date of Patent: Dec. 15, 2020

(54) OUTLET DEVICE CONFIGURED TO SWITCH BETWEEN DIFFERENT OUTLET WATER TYPES

(71) Applicant: XIAMEN SOLEX HIGH-TECH INDUSTRIES CO., LTD., Fujian (CN)

(72) Inventors: Fengde Lin, Fujian (CN); Mingfu Zhang, Fujian (CN); Hailang Gong, Fujian (CN); Wenxing Chen, Fujian (CN)

(73) Assignee: XIAMEN SOLEX HIGH-TECH INDUSTRIES CO., LTD, Xiamen (CN)

( * ) Notice: Subject to any disclaimer, the term of this patent is extended or adjusted under 35 U.S.C. 154(b) by 305 days.

(21) Appl. No.: 15/797,750

(22) Filed: Oct. 30, 2017

(65) Prior Publication Data

US 2018/0243764 A1 Aug. 30, 2018

(30) Foreign Application Priority Data

Feb. 24, 2017 (CN) ..... 2017 1 0103366

(51) Int. Cl.
*B05B 1/16* (2006.01)
*B05B 1/18* (2006.01)
*B05B 12/00* (2018.01)

(52) U.S. Cl.
CPC ..... *B05B 1/169* (2013.01); *B05B 1/16* (2013.01); *B05B 1/185* (2013.01); *B05B 12/002* (2013.01)

(58) Field of Classification Search
CPC ..... B05B 12/002; B05B 1/169; B05B 1/16; B05B 1/185
USPC ..... 239/440
See application file for complete search history.

(56) References Cited

U.S. PATENT DOCUMENTS 6,412,711 B1 * 7/2002 Fan ..... B05B 1/1636 239/446
7,114,666 B2 * 10/2006 Luettgen ..... B05B 1/1654 239/463
7,896,259 B2 * 3/2011 Meisner ..... B05B 1/1645 239/383
8,276,834 B2 * 10/2012 Qiu ..... B05B 1/1654 239/443
2005/0263617 A1 * 12/2005 Thong ..... B05B 1/1636 239/383
2014/0008464 A1 * 1/2014 Zhou ..... B05B 1/18 239/443
2014/0319248 A1 * 10/2014 Kinle ..... B05B 1/1636 239/443

* cited by examiner

*Primary Examiner* — Chee-Chong Lee
(74) *Attorney, Agent, or Firm* — Cooper Legal Group, LLC

(57) ABSTRACT

An outlet device capable of switching different outlet water types in a same outlet hole, has a main body and an outlet cover plate; the outlet cover plate and the main body shape a chamber; a water reversing element is disposed in the chamber, a driving element drives the water reversing element to move in the chamber in the directions closing to the outlet cover or away from the outlet cover; the water reversing element is disposed with reversing unit corresponding to the outlet holes of the outlet cover plate one by one, the reversing unit moves with the water reversing element and changes the distance to the reversing coupling unit, making the direction or vortex velocity of water flowing into the reversing coupling unit change.

14 Claims, 18 Drawing Sheets

OUTLET DEVICE CONFIGURED TO SWITCH BETWEEN DIFFERENT OUTLET WATER TYPES

FIELD OF THE INVENTION

The invention relates to sanitary ware, particularly to a water outlet device.

BACKGROUND OF THE INVENTION

Shower heads play an important role in modern life. With the improvement of people's living standards, the requirement to the shower head is also increasing. Different people have different requirements for the outlet water types. Some people like misty water spray, some people like columnar water spray, and some people like particle water spray. In order to meet the needs of different people, the shower heads provides several sets of outlet holes to control different mode, so the user can switch according to their own needs. But there are some limitations. Different outlet water types require different outlet holes, so the shower head need quite a number of outlet holes. What is more, only a part of the outlet holes are open in any mode, the outlet area is relatively small. If the outlet mode and the outlet area are taken into account, it is necessary to enlarge the area of the outlet cover plate to place more outlet holes. Therefore, the appearance of the shower is not simple and beautiful enough. On the other hand, the traditional outlet mode applies rotating to switch, the user needs a hand holding the shower, and the other hand rotating the shower water cover, making one-hand operation impossible.

SUMMARY OF THE INVENTION

The main technical problem to be solved by the present invention is providing a water outlet device in which each of the outlet holes is capable of having at least two outlet modes so that there is no need to prepare a corresponding outlet holes for each of the outlet modes, greatly reducing the size of the outlet cover plate.

In order to solve the above technical problems, the present invention provides an outlet device capable of switching different outlet water types in a same outlet hole, which comprises a main body and an outlet cover plate; the outlet cover plate and the main body shape a chamber; a water reversing element is disposed in the chamber, a driving element drives the water reversing element to move in the chamber in the directions closing to the outlet cover or away from the outlet cover;

The water reversing element is disposed with reversing unit corresponding to the outlet holes of the outlet cover plate one by one, the side of the outlet cover plate faced to the reversing unit is disposed with reversing coupling units coupled to the reversing units, the reversing coupling units are connected to the outlet holes; the reversing unit moves with the water reversing element and changes the distance to the reversing coupling unit, making the direction or vortex velocity of water flowing into the reversing coupling unit change.

In another preferred embodiment, when the water reversing element moves to the end in the direction closing to the outlet cover plate, water flows in a higher rate from the water reversing element to the reversing coupling unit; when the water reversing element moves to the end in the direction away from the outlet cover plate, the reversing units separate from the reversing coupling units, water flows directly to the reversing coupling unit to form column water; when the water reversing element moves to a central position, water flows in a lower rate from the water reversing element to the reversing coupling unit.

In another preferred embodiment, the outlet hole comprises an inlet cavity and an outlet passage connected to the inlet cavity; the inlet cavity has the width of the opening gradually shrunken from the end away from the outlet passage to the end connected to the outlet passage.

In another preferred embodiment, the reversing unit comprises a sink hole in the moving direction of the water reversing element, the outlet end of the sink hole is disposed above the outlet hole correspondingly; the outer surface of the side wall of the sink hole is disposed with a plurality of first incline holes connected to the sink hole in the periphery direction; the first incline holes are arranged rotatably symmetrically in the axial direction of the sink hole, the first incline sink holes are extending along the moving direction of the water reversing element.

In another preferred embodiment, the outer surface of the side wall of the sink hole is disposed with a boss ring extending outwardly at the end away from the outlet cover plate; the boss ring is disposed with a plurality of second incline holes connected to the sink hole in the periphery direction; the second incline holes are arranged rotatably symmetrically in the axial direction of the sink hole.

In another preferred embodiment, the end of the first incline hole closing to the outlet cover plate is extending to the end face of the outer wall of the outlet end of the sink hole, and the end away from the outlet cover plate is connected to the second incline hole.

In another preferred embodiment, the reversing coupling unit is a groove, the bottom surface of the groove is connected to the inlet cavity; when the water reversing element moves to the end in the direction closing to the outlet cover plate, the first incline hole completely enters the groove; when the water reversing element moves to the central position, a portion of the first incline hole enters the groove.

In another preferred embodiment, when the water reversing element moves to the end in the direction away from the outlet cover plate, the sink hole is situated at the outer side of the groove; the water pressure in the sink hole and at the outer side of the sink hole are substantially equal, the outlet water type is column water.

In another preferred embodiment, when the water reversing element moves to the end in the direction closing to the outlet cover plate, the first incline hole completely enters the groove, the first incline hole is closed; water in the second incline hole flows inclined to the inlet cavity to form a quick vortex water.

In another preferred embodiment, when the water reversing element moves to the central position, a portion of the first incline hole enters the groove, water in the first incline hole flows inclined to the inlet cavity to form a slow vortex water.

In another preferred embodiment, when the water reversing element moves in the direction closing to the outlet cover plate, water flows to the reversing unit from one direction to couple to the reversing coupling unit to form shaking pulsing water; when the water reversing element moves to the end in the direction away from the outlet cover plate, water flows to the reversing unit from another direction to couple to the reversing coupling unit to form pulverization water; when the water reversing element moves to the central position, water flows to the reversing unit from the two directions to couple to the reversing coupling unit to form particle water.

In another preferred embodiment, the reversing coupling unit is a hemispherical inlet cavity, which is connected to an outlet passage, the outlet passage has the opening gradually enlarged from the end connected to the inlet cavity to the other end.

In another preferred embodiment, reversing unit comprises a straight flowing hole running throughout along the moving direction of the water reversing element, the outlet end of the straight flowing hole is connected to a hemispherical outlet cavity; the outlet cavity is disposed above the inlet cavity correspondingly.

In another preferred embodiment, the outlet end of the outlet cavity is connected to a groove, the opening end of the groove is faced to the outlet cavity, the diameter of the bottom surface of the groove is larger than the diameter of the outlet cavity, the groove is connected to the outlet cavity; the side wall of the groove is disposed with a plurality of incline hole connected to the groove in the periphery direction; the incline holes are arranged rotatably symmetrically in the axial direction of the groove, the incline hole extends to the end face of the opening end of the groove.

In another preferred embodiment, the side of the outlet cover plate close to the water reversing element is disposed with an annular groove coaxial with the inlet cavity at the outer periphery of the inlet cavity.

In another preferred embodiment, the main body comprises a fixing base; when the water reversing element moves to the end in the direction away from the outlet cover plate, the end of the straight flowing hole away from the outlet cover plate abuts against the fixing base of the main body, the straight flowing hole is closed; the water of the incline hole flows inclined to the inlet cavity to form a slow vortex water.

In another preferred embodiment, when the water reversing element moves to the end in the direction closing to the outlet cover plate, the incline hole is completely inserted to the annular groove, the incline hole is closed; the inlet cavity and the outlet cavity joint to form a spherical cavity, water from the straight flowing hole flows through the spherical cavity and shakes to form pulsing water.

In another preferred embodiment, when the water reversing element moves to the central position, a portion of the incline hole is inserted to the annular groove, the incline hole and the straight flowing hole are both open, the inlet cavity and the outlet cavity are spaced with a certain distance.

In another preferred embodiment, the driving element comprises a rotating element and a guiding element, the guiding element is linked to the water reversing element; the guiding element is disposed with a step group along the rotating direction of the rotating element, the step group comprises at least two steps, two steps are transited by a guiding incline surface;

the rotating element is disposed with an abutting block abutting against the step; when the rotating element rotates with respect to the guiding element, the abutting block rotates along the guiding incline surface and abuts against the next step, making the guiding element drive the water reversing element to move in the directions closing to the outlet cover plate and away from the outlet cover plate.

In another preferred embodiment, comprising a reset element; when the rotating element moves from a lower step to a higher step, the reset element restores elastic force; when the rotating element moves from a higher step to a lower step, the reset element releases the elastic force to drive the guiding element and the water reversing element to move and reset in the direction away from the outlet cover plate.

In another preferred embodiment, further comprising a reset element, the reset element is linked to the water reversing element and is disposed with a second step group disposed along the rotating direction of the rotating element; the reset element and the step group of the guiding element are symmetrically opposite to each other to form a moving passage for the abutting block; the abutting block is disposed in the moving passage; when the abutting block moves from a lower step to a higher step, the action force abutting against the abutting block drives the water reversing element to move in the direction closing to the outlet cover plate; when the abutting block moves from a higher step to a lower step, the action force abutting against the reset element drives the water reversing element to move in the direction away from the outlet cover plate.

In another preferred embodiment, further comprising an operation element, the operation element drives a ratchet wheel-ratchet mechanism to rotate intermittently; the rotating element comprising a rotate shaft connected to the ratchet wheel.

In another preferred embodiment, the operation element is a button disposed at the main body of a shower head; when the button is pressed, the button pushes a pendulum block to swag; one end of the pendulum block abuts against the button, the other end abuts against the ratchet.

Compared with the prior art, the technical proposal of the invention has the following beneficial effects:

1. The present invention provides an outlet device capable of switching different outlet water types in a same outlet hole that the reversing unit moves with the water reversing element, making the direction or vortex velocity of water flowing into the reversing coupling unit change. Therefore, in the same outlet hole, different flow or direction can change the outlet modes. This achieves that each of the outlet holes is capable of having at least two outlet modes. Users can switch according to their own needs. There is no need to prepare a corresponding outlet holes for each of the outlet modes, the number of holes is greatly reduced, and the size of the outlet cover plate can be made small, thus reducing the volume of the shower. Besides, each water outlet mode can cover all the outlet holes on the outlet cover plate. It can solve the problem of small outlet area and poor experience.
2. The present invention provides an outlet device capable of switching different outlet water types in a same outlet hole that the purpose of switching is achieved by the water reversing element moving in the axial direction. And by the button driving the ratchet wheel-ratchet mechanism to move intermittently, such to drive the water reversing element to move in the axial direction, the method of the invention can achieve the whole switching operation by one hand compared with the traditional way of rotating the water diversion plate.
3. The present invention provides an outlet device capable of switching different outlet water types in a same outlet hole that regardless of which water type is used by the user, water flows out of all outlet holes on the outlet cover plate, thus ensuring that the area of the water type is still able to meet the needs of the user even the area of the outlet cover plate is small.
4. The present invention provides an outlet device capable of switching different outlet water types in a same outlet hole, which effectively solves the problem of the existing multi-function shower that after user switch the outlet mode, the water would remain in the outlet cavity corresponding to the former outlet mode, so when the user switches back to that mode, the cool water remained in the corresponding cavity would pour the user which make user feel uncomfortable. The present invention realizes that each outlet hole has at least two outlet modes, so different water types can achieve by the same outlet hole.

DETAILED DESCRIPTION OF THE EMBODIMENTS

Figure 1:
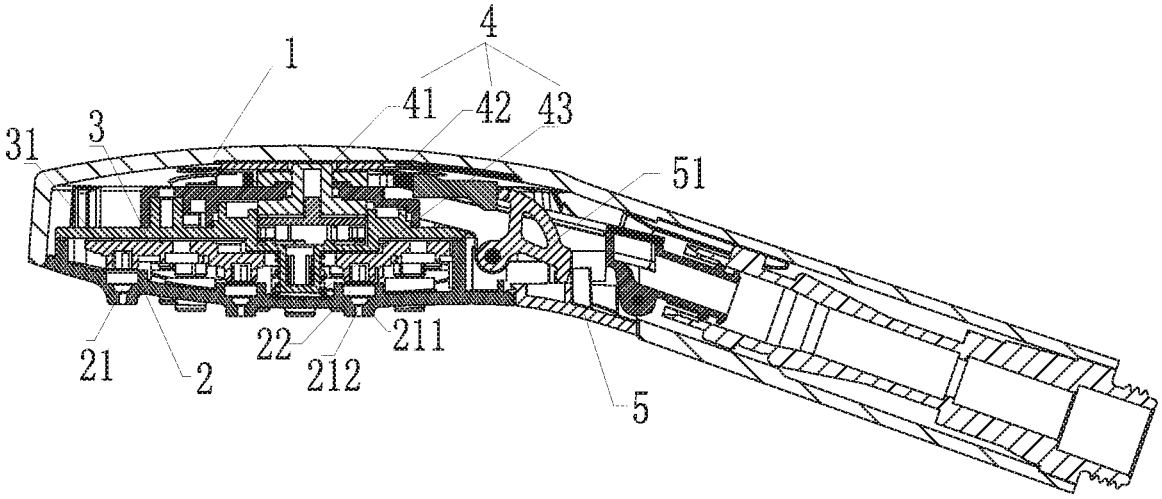
FIG. 1 is a structure cutaway view of the first embodiment of the present invention.
Figure 2:
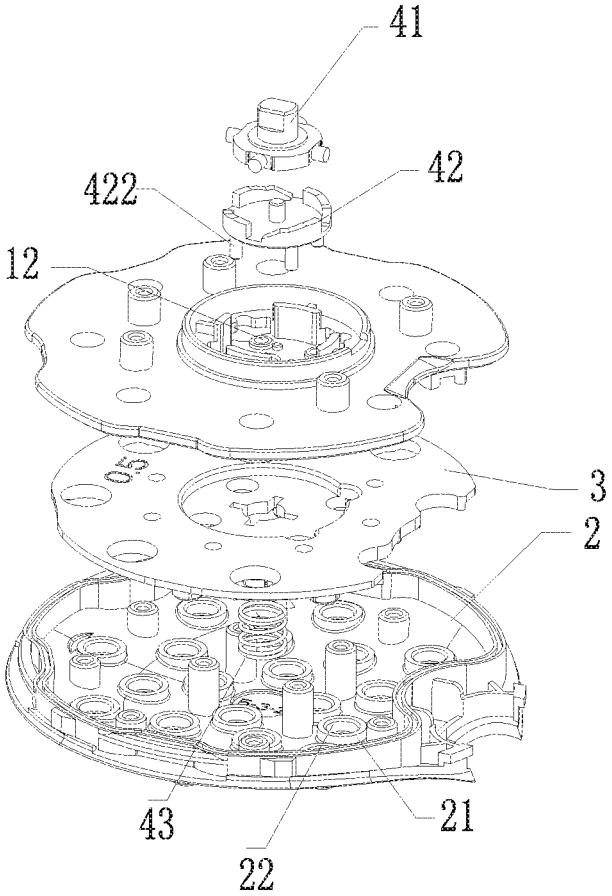
FIG. 2 is a structural exploded view of the first embodiment of the present invention.
Figure 3:
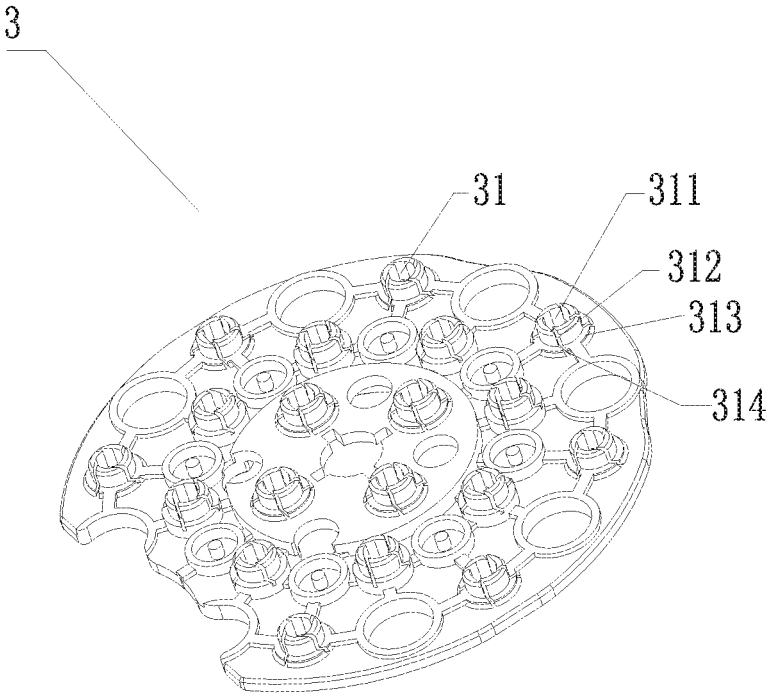
FIG. 3 is a schematic view of the water reversing element of the first embodiment of the present invention.
Figure 4:
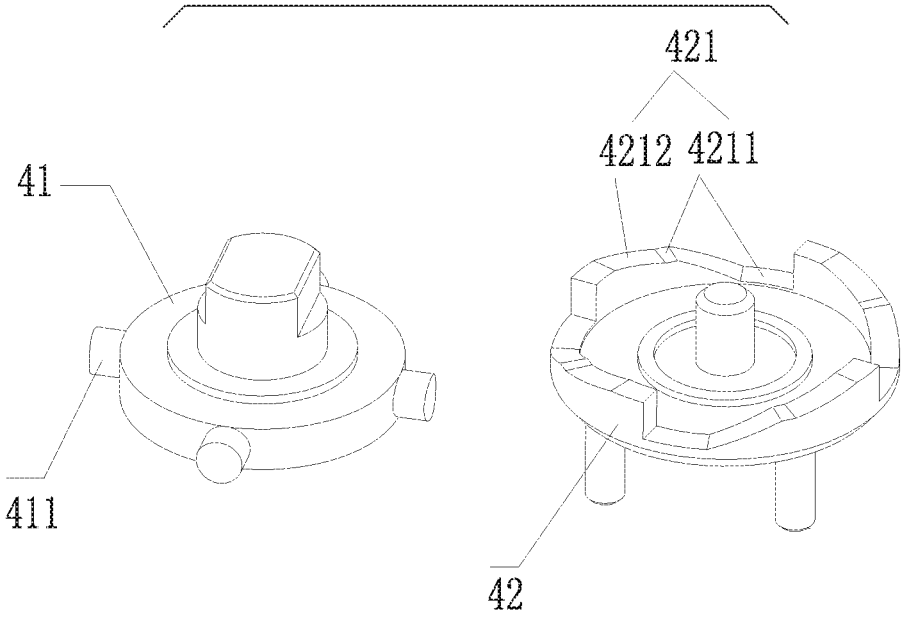
FIG. 4 is a schematic view of the driving element of the first embodiment of the present invention.
Figure 5:
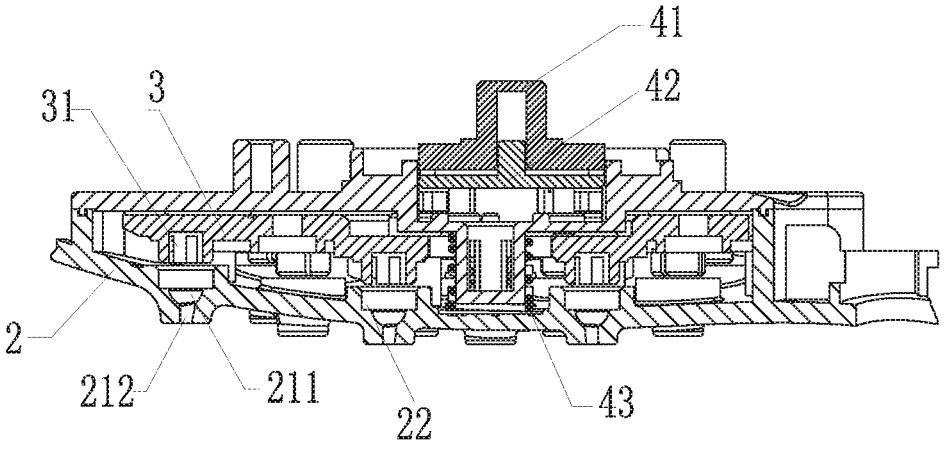
FIG. 5 is a cutaway view of the first outlet in the first embodiment of the present invention.
Figure 6:
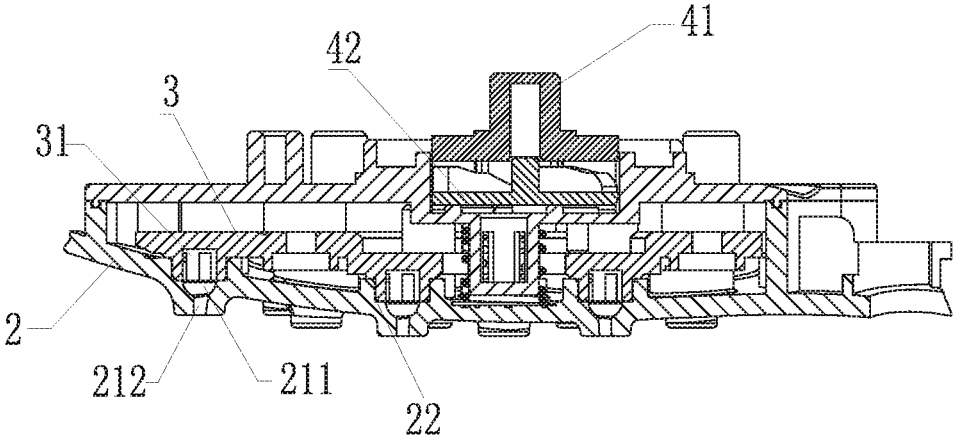
FIG. 6 is a cutaway view of the second outlet in the first embodiment of the present invention.
Figure 7:
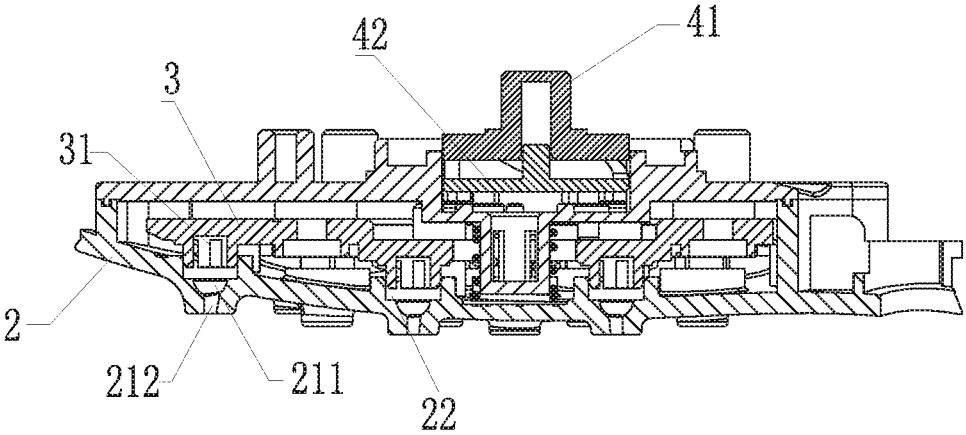
FIG. 7 is a cutaway view of the third outlet in the first embodiment of the present invention.
Figure 8:
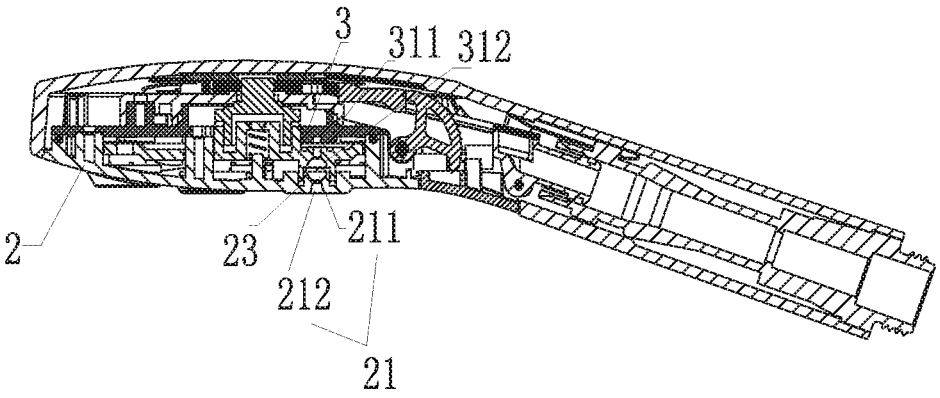
FIG. 8 is a structure cutaway view of the second embodiment of the present invention.
Figure 9:
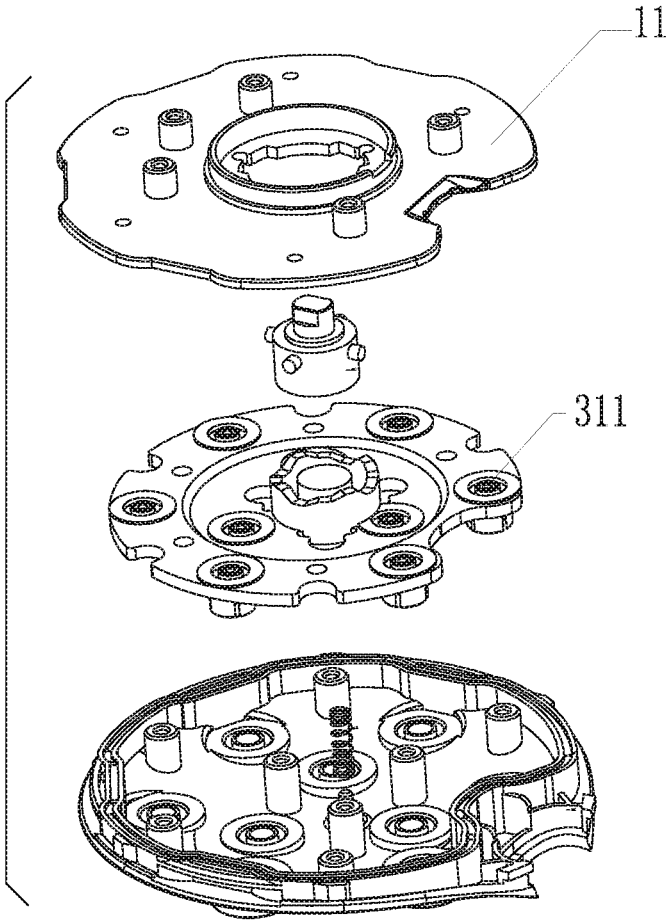
FIG. 9 is a structural exploded view of the second embodiment of the present invention.
Figure 10:
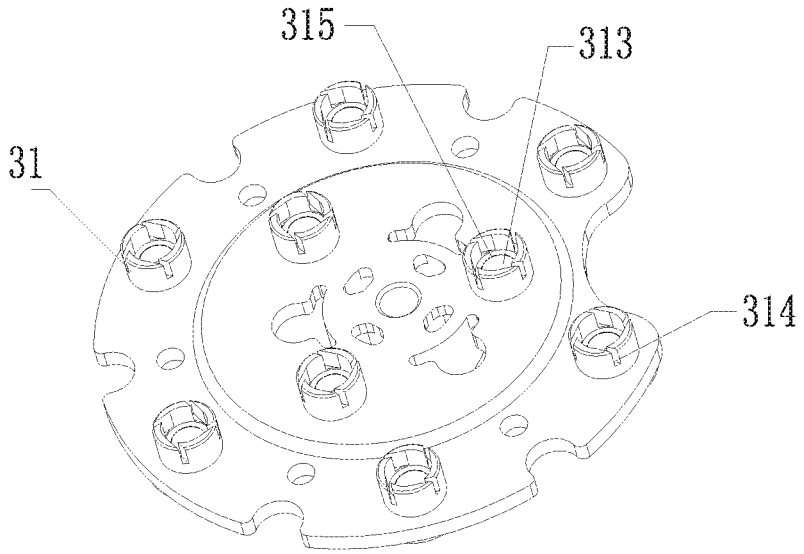
FIG. 10 is a schematic view of the water reversing element of the second embodiment of the present invention.
Figure 11:
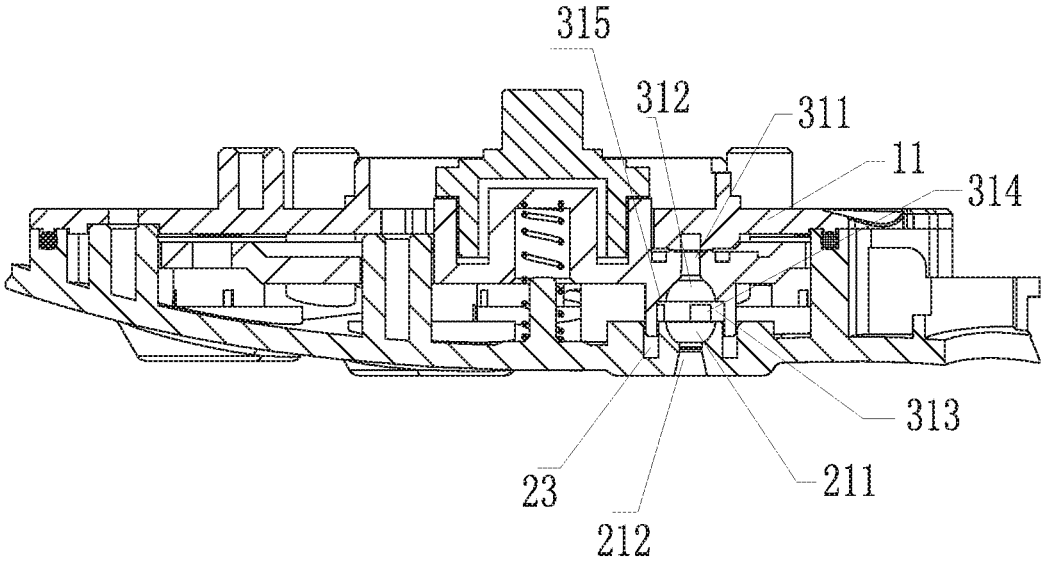
FIG. 11 is a cutaway view of the first outlet in the second embodiment of the present invention.
Figure 12:
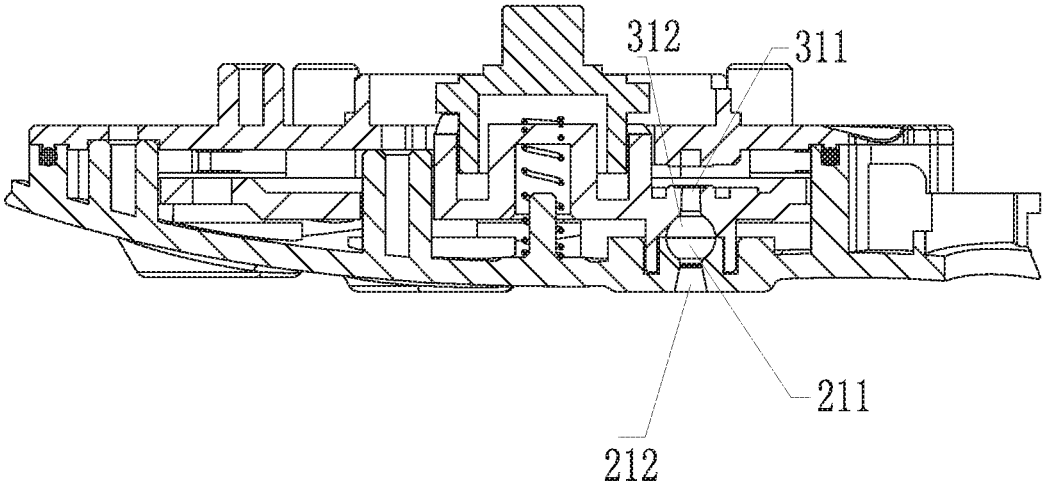
FIG. 12 is a cutaway view of the second outlet in the second embodiment of the present invention.
Figure 13:
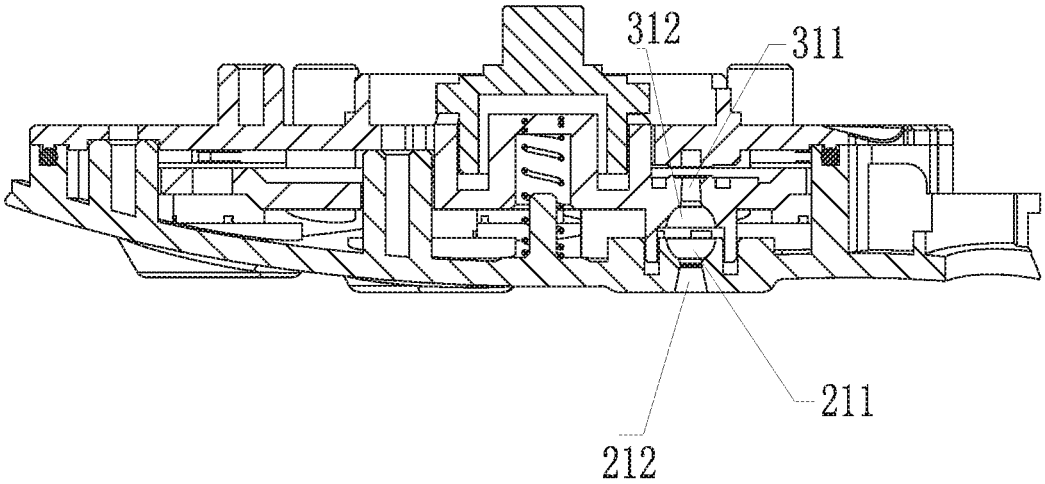
FIG. 13 is a cutaway view of the third outlet in the second embodiment of the present invention.

The invention will be described in further detail referring to the accompanying drawings and specific embodiments.

First Embodiment

Referring to FIGS. 1-7, an outlet device capable of switching different outlet water types in a same outlet hole comprises a main body 1 and an outlet cover plate 2; the outlet cover plate 2 and the main body 1 shape a chamber; a water reversing element 3 is disposed in the chamber, a driving element 4 drives the water reversing element 3 to move in the chamber in the directions closing to the outlet cover 2 and away from the outlet cover 2;

The water reversing element 3 is disposed with reversing unit 31 corresponding to the outlet holes 21 of the outlet cover plate one by one, the side of the outlet cover plate 2 faced to the reversing unit 31 is disposed with reversing coupling units coupled to the reversing units, the reversing coupling units are connected to the outlet holes 21; the reversing unit 31 moves with the water reversing element 3 and changes the distance to the reversing coupling unit, making the direction or vortex velocity of water flowing into the reversing coupling unit change. The water type can be changed in the same outlet hole 21 due to the different vortex velocity or inlet direction. It achieves that each outlet hole 21 is capable of having at least two water types. Users can switch according to their own needs. There is no need to prepare corresponding outlet holes 21 for the outlet modes, the number of holes 21 is greatly reduced, so the size of the outlet cover plate 2 can be very small, thus reducing the volume of the shower head.

Furthermore, the cooperation principle of the reversing unit 31 and the reversing coupling unit is as follows: when the water reversing element 3 moves to the end in the direction closing to the outlet cover plate 2, water flows in a higher rate from the water reversing element to the reversing coupling unit; when the water reversing element 3 moves to the end in the direction away from the outlet cover plate 2, the reversing units 31 separate from the reversing coupling units, water flows directly to the reversing coupling unit to form column water; when the water reversing element 3 moves to a central position, water flows in a lower rate from the water reversing element 3 to the reversing coupling unit.

The particular structure of this embodiment is as follows: the outlet hole 21 comprises an inlet cavity 211 and an outlet passage 212 connected to the inlet cavity 211; the inlet cavity 211 has the width of the opening gradually shrunken from the end away from the outlet passage 212 to the end connected to the outlet passage. The reversing unit 31 comprises a sink hole 311 in the moving direction of the water reversing element 3, the outlet end of the sink hole 311 is disposed above the outlet hole 21 correspondingly; the outer surface of the side wall of the sink hole 311 is disposed with a plurality of first incline holes 312 connected to the sink hole 311 in the periphery direction; the first incline holes 312 are arranged rotatably symmetrically in the axial direction of the sink hole 311, the first incline sink holes 312 are extending along the moving direction of the water reversing element 3. After the diversion of the first incline holes 312, the water flow forms vortex before entering the outlet hole 21, and the water flow state in the inlet cavity 211 can be changed by opening or closing the first incline holes 312.

Furthermore, the outer surface of the side wall of the sink hole 311 is disposed with a boss ring 313 extending outwardly at the end away from the outlet cover plate 2; the boss ring 313 is disposed with a plurality of second incline holes 314 connected to the sink hole 311 in the periphery direction; the second incline holes 314 are arranged rotatably symmetrically in the axial direction of the sink hole 311. And the second incline holes 314 are extending in the horizontal direction. By opening or closing the first incline holes 312, the inlet flow rate in the reversing unit 31 is possible to change, so that the vortex velocity of the water flowing into the outlet holes 21 from the reversing unit 31 is changed. The end of the first incline hole 312 near the outlet cover plate 2 is extending to the end face of the outer wall of the outlet end of the sink hole 311, and the end away from the outlet cover plate 2 is connected to the second incline hole 314.

In order to achieve that the first incline hole 312 is open or closed by the moving of the water reversing element 3, the reversing coupling unit is a groove 22 disposed on the side of the outlet cover plate 2 near the water reversing element 3. The bottom surface of the groove 22 is connected to the inlet cavity 211, and the diameter of the bottom surface of the groove 22 is larger than the outer diameter of the peripheral wall of the sink hole 311, so that the sink hole 311 can enter the groove 22; when the water reversing element 3 moves to the end in the direction closing to the outlet cover plate 2, the first incline hole 312 completely enters the groove 22; when the water reversing element 3 moves to the central position, the boss 313 and the top portion of the periphery of the groove 22 are separated, a portion of the first incline hole 312 enters the groove 22.

The following is a further description of water types of the outlet hole 21 with the moving process of water reversing element 3:

1) When the water reversing element 3 moves to the end in the direction away from the outlet cover plate 2, the sink hole 311 is situated at the outer side of the groove 22; water fills up the cavity, water pressure in the sink hole 311 and at the outer side of the sink hole 311 are substantially equal, therefore, even there is water running through the incline hole, no vortex is formed in the inlet cavity 211, the outlet type of outlet passage 212 is normal column water.
2) When the water reversing element 3 moves to the end in the direction closing to the outlet cover plate 2, the boss 313 abuts against the top portion of the peripheral wall of the groove 22, so the first incline hole 312 is closed; water in the second incline hole 314 flows inclined to the sink hole 311 to form quick vortex water, and then flows into the inlet cavity 211. The vortex water, which has a high vortex velocity, flows through the inlet cavity 211 and then flows out of the outlet passage 212 to form pulverization water with very fine particles.
3) When the water reversing element 3 moves to the central position, a portion of the first incline hole 312 enters the groove 22, water in the first incline hole 312 and the second incline hole 314 flows inclined to the sink hole 311 to form slow vortex water, and then flows into the inlet cavity 211. The vortex water, which has a slow vortex velocity, flows through the inlet cavity 211 and then flows out of the outlet passage 212 to form the particle water with coarse particles.

In this embodiment, the driving element 4 comprising a rotating element 41 and a guiding element 42, the guiding element 42 is linked to the water reversing element 3. In this embodiment, the guiding element 42 is disposed with post 422 in the axial direction. The main body 1 is disposed with a guiding hole 12, and the guide hole 12 runs through the post 422, and abuts against the water reversing element 3; when the rotary element 41 rotates, the guiding element 42 moves in the axial direction due to the action of the post 422 and the guiding hole 12.

The guiding element 42 is disposed with a step group 421 along the rotating direction of the rotating element 41; the step group 421 comprises at least two steps 4211. The height of the next step 4211 in the direction of rotation of the rotary element 41 is higher than that of the prior step 4211. The steps 4211 are transited by a guiding incline surface 4212; In this embodiment, there are three steps 4211 corresponding to above three outlet modes.

The rotating element 41 is disposed with an abutting block 411 abutting against the step 4211; when the rotating element 41 rotates with respect to the guiding element 42, the abutting block 411 rotates along the guiding incline surface 4212 and abuts against the next step 4211, making the guiding element 42 drive the water reversing element 3 to move in the direction closing to the outlet cover plate 2. This achieves that when the rotating element 41 rotates, the water reversing element 3 moves in the direction close to the outlet cover plate 2.

In order to further realize that the water reversing element 3 moves in the direction away from the outlet cover plate 2, the driving element 4 in this embodiment comprises a reset element 43. When the abutting block 411 is on the lowest step surface, the reset element 43 is pre-compressed; when the abutting block 411 moves from a lower step to a higher step, the pressing force of the abutting block 411 applied by the guiding element 42 is transmitted to the reset element 43 through the water reversing element 3, the reset element 43 restores elastic force; when the abutting block 411 moves from a higher step to a lower step, the reset element 43 releases the elastic force to drive the guiding element 42 and the water reversing element 3 to move and reset in the direction away from the outlet cover plate 2.

In the present embodiment, the reset element 43 is a spring, and two ends of the spring respectively abut against the water reversing element 3 and the outlet cover plate 2.

In the present embodiment, in order to facilitate the switch operations, an operation element 5 is further provided, the operation element 5 drives a ratchet wheel-ratchet mechanism to rotate intermittently; the rotary shaft of the rotating element 41 is fixedly connected to the ratchet wheel. The ratchet wheel-ratchet mechanism rotates once, the abutting block 411 of the rotating element 41 moves to the next step 4211 along the rotation direction.

The operation element 5 is a button arranged on the main body 1, when the button is pressed, the button pushes a pendulum block 51 to swag; one end of the pendulum block 51 abuts against the button, the other end abuts against the ratchet. In this way, the user can press the button to drive the ratchet wheel-ratchet mechanism to rotate, and the user can complete the whole process only by one hand.

Second Embodiment

Refer to FIGS. 8-13, the difference between this embodiment and the first embodiment is as follows: when the water reversing element 3 moves to the end in the direction closing to the outlet cover plate 2, water flows to the reversing unit 31 from one direction to couple to the reversing coupling unit to form shaking pulsing water; when the water reversing element 3 moves to the end in the direction away from the outlet cover plate 2, water flows to the reversing unit 31 from another direction to couple to the reversing coupling unit to form pulverization water; when the water reversing element 3 moves to the central position, water flows to the reversing unit 31 from the two directions to couple to the reversing coupling unit to form particle water.

In order to achieve above effect, the reversing coupling unit is a hemispherical inlet cavity 211, which is connected to an outlet passage 212, the outlet passage 212 has the opening gradually enlarged from the end connected to the inlet cavity 211 to the other end. The reversing unit 31 comprises a straight flowing hole 311 running throughout along the moving direction of the water reversing element 3, the outlet end of the straight flowing hole 311 is connected to a hemispherical outlet cavity 312; the outlet cavity 312 is disposed above the inlet cavity 211 correspondingly. The inlet cavity 211 is a hemispherical cavity with the sidewall being a transition curved surface.

The outlet end of the outlet cavity 312 is connected to a groove 313, the opening end of the groove 313 is faced to the outlet cavity 211, the diameter of the bottom surface of the groove 313 is larger than the diameter of the outlet cavity 312, and form a step surface 315; the side wall of the groove 313 is disposed with a plurality of incline hole 314 connected to the groove 313 in the periphery direction; the incline holes 314 are arranged rotatably symmetrically in the axial direction of the groove 313. One end of the incline hole 314 extends to the end face of the opening end of the groove 313, the other end extends toward the step surface 315 and is slightly below or aligned with the step surface 315.

In this embodiment, in order to form pulsing water, the outlet passage 212 has the opening gradually enlarged from the end connected to the inlet cavity 211 to the other end. Therefore, the outlet passage 212 is integrally trumpet shaped.

The side of the outlet cover plate 2 near to the water reversing element 3 is disposed with an annular groove 23 coaxial with the inlet cavity 211 at the outer periphery of the inlet cavity 211. The outer diameter of the side wall of the groove 313 is smaller than the outer diameter of the annular groove 23 and the inner diameter of the side wall of the groove 313 is larger than the small diameter of the annular groove 23, so that the side wall of the groove 313 can freely enter and exit the annular groove 23.

The following is a further description of water types of the outlet hole 21 in the moving process of water reversing element 3:

1) When the water reversing element 3 moves to the end in the direction closing to the outlet cover plate 2, the end of the straight flowing hole 311 away from the outlet cover plate 2 abuts against the fixing base 11 of the main body 1, the straight flowing hole 311 is closed; water in the incline hole 314 flows inclined to the groove 313 and forms quick vortex water, and then flows into the inlet cavity 211. The vortex water, which has a high vortex velocity, flows through the inlet cavity 211 and then flows out of the trumpet shaped outlet passage 212 to form the hollow shape pulverization water with very fine particles.
2) When the water reversing element 3 moves to the end in the direction closing to the outlet cover plate 2, the side wall of the groove 313 is inserted to the annular groove 23, and the top surface of inlet cavity 211 abuts against the step surface 315, making the incline hole 314 closed; the inlet cavity 211 and the outlet cavity 312 joint to form a spherical cavity, water from the straight flowing hole 311 flows through the spherical cavity and shakes to form pulsing water with a certain oscillation frequency.
3) When the water reversing element 3 moves to the central position, a portion of the incline hole 314 is inserted to the annular groove 23, the incline hole 314 and the straight flowing hole 311 are open at the same time, the inlet cavity 211 and the outlet cavity 312 are spaced with a certain distance. Water in the incline hole 314 flows inclined to the inlet cavity 211 to form slow vortex water, the slow vortex water collides with the straight flush of the straight flowing hole 311, and then flows out of the trumpet shaped outlet passage 212 to form particle water with coarse particles.

The other structure of the embodiment is the same as the embodiment 1, that it will not be further described.

Third Embodiment

Figure 14:
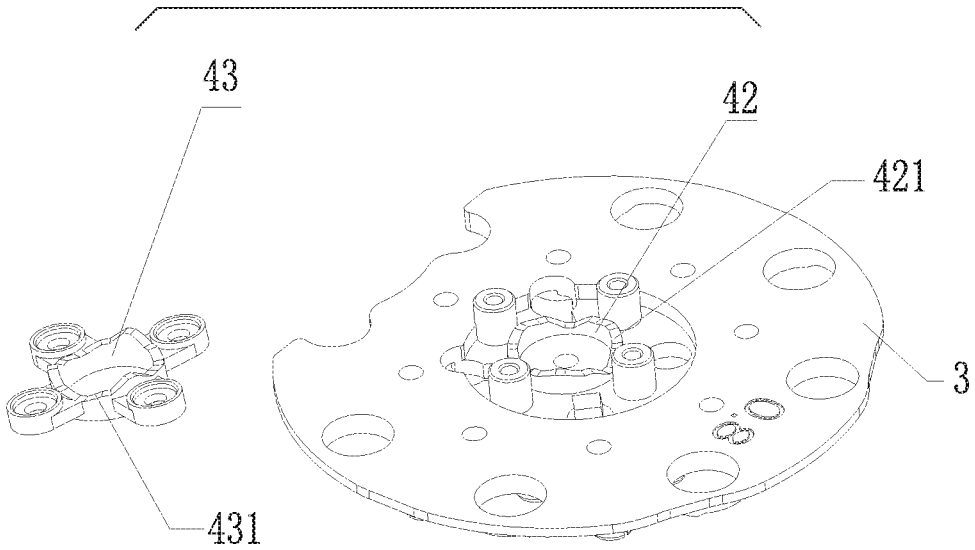
FIG. 14 is a schematic view of the decomposition of guiding element and reset element in the third embodiment of the present invention.
Figure 15:
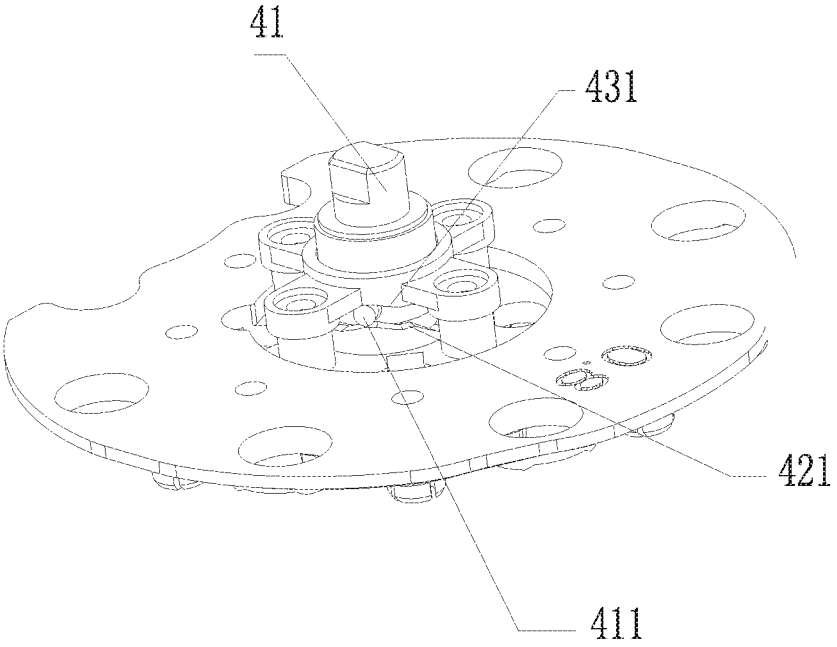
FIG. 15 is a schematic view of the combination of guiding element and reset element in the third embodiment of the present invention.
Figure 16:
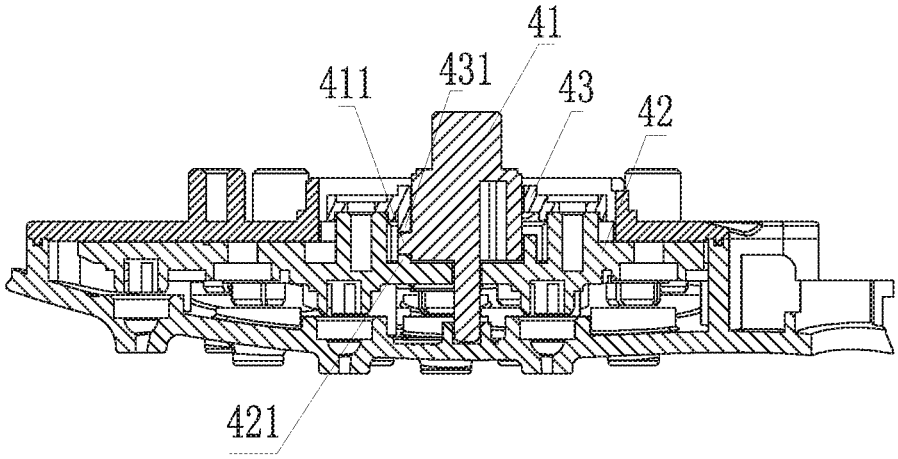
FIG. 16-18 are schematic views showing the movement of the water reversing element in the third embodiment of the present invention.
Figure 17:
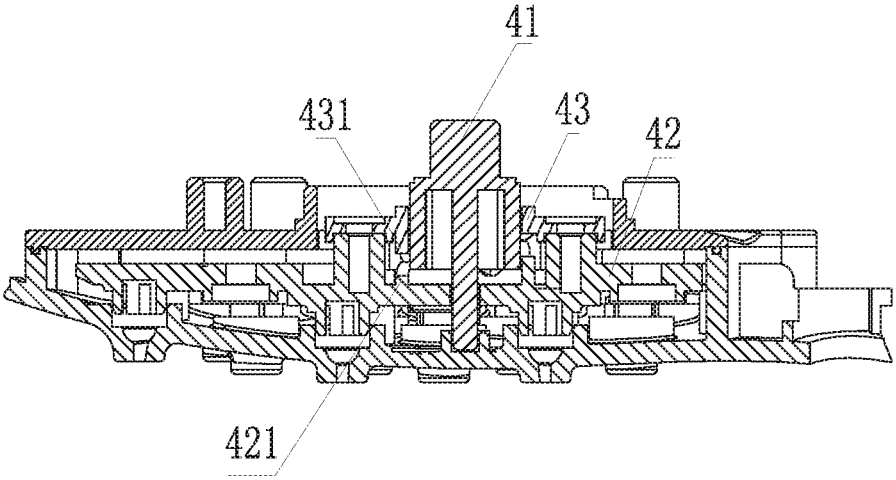
Figure 18:
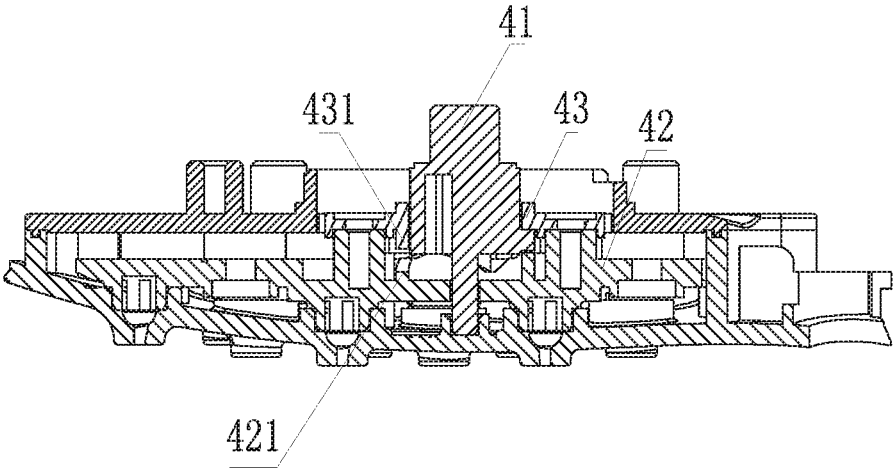

Refer to FIGS. 14-15, the difference between this embodiment and the first embodiment is as follows: in this embodiment, in order to further realize that the water reversing element 3 moves in the direction away from the outlet cover plate 2, a reset element 43 is further provided. The reset element 43 is linked to the water reversing element 3 and is disposed with a second step group 432 disposed along the rotating direction of the rotating element; the reset element 43 and the step group 421,431 of the guiding element 42 are symmetrically opposite to each other to form a moving passage for the abutting block 411;

The abutting block 411 is disposed in the moving passage; when the rotating element 41 drives the abutting block 411 to move from a lower step to a higher step, the action force abutting against the guiding element 42 drives the water reversing element 3 to move in the direction closing to the outlet cover plate 2; when the abutting block 411 moves from a higher step to a lower step, the action force abutting against the reset element 43 drives the water reversing element 3 to move in the direction away from the outlet cover plate 2, as shown in FIGS. 16-18.

In contrast to the first embodiment in which the spring is used to achieve reset, as the elastic force needed to overcome the compression is different with the deforming of the spring. This results in a bad operation experience as the force required is different when the user switches from the first gear to the second gear, switches from the second gear to the third gear. In addition, the reset force of the spring is large, so that the water reversing element 3 impacts with the fixing base 4 and sounds abnormally. The reset scheme of the present embodiment solves the above two problems, the switching always feel consistent, and no abnormal sound exists during the process.

In this embodiment, for realizing the linkage relationship between the reset element 43 and the water reversing element 3, the side of the water reversing element 3 away from the outlet cover plate 2 is fixedly disposed with the guiding element 42. The external periphery of the guiding element 42 is disposed with a plurality of protruding columns in the axial direction. The top end of the protruding column is a threaded hole; the reset element 43 is fixedly connected with the threaded hole through a bolt, thereby realizing the linkage relationship between the reset element 43 and the water reversing element 3 in the axial direction.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An outlet device configured to switch between different outlet water types, comprising:

a main body, and an outlet cover plate, wherein:

the outlet cover plate and the main body define a chamber, a water reversing element is disposed in the chamber, the water reversing element moves in a direction toward the outlet cover plate or away from the outlet cover plate in the chamber, the water reversing element comprises a plurality of reversing units, the outlet cover plate comprises a plurality of outlet holes, each reversing unit of the plurality of reversing units corresponds to a corresponding one outlet hole of the plurality of outlet holes, each reversing unit of the plurality of reversing units comprises a sink hole disposed in a moving direction of the water reversing element, a side of the outlet cover plate facing the plurality of reversing units comprises a plurality of reversing coupling units coupled to the plurality of reversing units, the plurality of reversing coupling units are connected to the plurality of outlet holes, each reversing coupling unit of the plurality of reversing coupling units comprises a groove, when the water reversing element moves toward the outlet cover plate to a first position adjacent to the outlet plate cover, water flows at a first rate from the water reversing element to the plurality of reversing coupling units, when the water reversing element moves away from the outlet cover plate to a second position away from the outlet plate cover:

the plurality of reversing units separate from the plurality of reversing coupling units, and the water flows directly to the plurality of reversing coupling units to form column water, when the water reversing element moves to a middle position between the first position and the second position, the water flows at a second rate from the water reversing element to the plurality of reversing coupling units, and the first rate is higher than the second rate.

2. The outlet device configured to switch between different outlet water types according to claim 1, wherein:

each outlet hole of the plurality of outlet holes comprises an inlet cavity and an outlet passage connected to the inlet cavity, each inlet cavity of the inlet cavities comprises an opening, and a width of each opening of the openings gradually reduces from a first end of each opening of the openings away from the outlet passage to a second end of each opening of the openings connected to the outlet passage.

3. The outlet device configured to switch between different outlet water types according to claim 2, wherein:

an outlet end of each sink hole of the sink holes is disposed above the corresponding one outlet hole of the plurality of outlet holes, a side wall of each sink holes of the sink holes comprises a plurality of first incline holes arranged in a circumferential direction around a corresponding one sink hole of the sink holes, the plurality of first incline holes are rotatably symmetrically disposed in an axial direction of the corresponding one sink hole of the sink holes, and the plurality of first incline holes extend along the moving direction of the water reversing element.

4. The outlet device configured to switch between different outlet water types according to claim 3, wherein:

an outer surface of a first end of the side wall of each sink hole of the sink holes disposed away from the outlet cover plate comprises a convex ring extending outward, each convex ring of the convex rings comprises a plurality of second incline holes connected to a corresponding one sink hole of the sink holes in a circumferential direction of the corresponding one sink hole of the sink holes, and the plurality of second incline holes are rotatably symmetrically disposed in the axial direction of the corresponding one sink hole of the sink holes.

5. The outlet device configured to switch between different outlet water types according to claim 4, wherein:

a first end of each first incline hole of the plurality of first incline holes adjacent to the outlet cover plate extends toward a first end face of an outer end of an outer wall of each sink hole of the sink holes, and a second end of each first incline hole of the plurality of first incline holes disposed away from the outlet cover plate is connected to a corresponding one second incline hole of the plurality of second incline holes.

6. The outlet device configured to switch between different outlet water types according to claim 5, wherein:

a bottom surface of each groove of the grooves is connected to a corresponding one inlet cavity of the inlet cavities, when the water reversing element moves toward the outlet cover plate to the first position, a corresponding first incline hole of the plurality of first incline holes completely enters a corresponding one groove of the grooves, when the water reversing element moves to the middle position, a portion of the corresponding first incline hole enters the corresponding one groove of the grooves.

7. The outlet device configured to switch between different outlet water types according to claim 6, wherein:

when the water reversing element moves away from the outlet cover plate to the second position:

each sink hole of the sink holes is disposed on an outer side of the corresponding one groove of the grooves, and water pressure in each sink hole of the sink holes and water pressure at an outer side of each sink hole of the sink holes are equal.

8. The outlet device configured to switch between different outlet water types according to claim 6, wherein:

when the water reversing element moves toward the outlet cover plate to the first position, each first incline hole of the plurality of first incline holes completely enters a corresponding one groove of the grooves, the plurality of first incline holes are closed, and the water obliquely flows from the plurality of second incline holes to the inlet cavities to form vortexes.

9. The outlet device configured to switch between different outlet water types according to claim 6, wherein:

when the water reversing element moves to the middle position:

a portion of each first incline hole of the plurality of first incline holes enters a corresponding one groove of the grooves, and the water obliquely flows from the plurality of first incline holes to a corresponding one inlet cavity of the inlet cavities to form vortexes.

10. The outlet device configured to switch between different outlet water types according to claim 1, wherein:

a driving element drives the water reversing element to move in the direction toward the outlet cover plate or away from the outlet cover plate in the chamber, the driving element comprises a rotating element and a guiding element, the guiding element is connected to the water reversing element, the guiding element comprises a first plurality of steps along a rotating direction of the rotating element, two adjacent steps of the first plurality of steps are connected by a guiding incline surface, the rotating element comprises an abutting block configured to abut each step of the first plurality of steps, and when the rotating element rotates with respect to the guiding element, the abutting block rotates along the guiding incline surface and abuts a next step of the first plurality of steps, causing the guiding element to drive the water reversing element to move in the direction toward the outlet cover plate or away from the outlet cover plate.

11. The outlet device configured to switch between different outlet water types according to claim 10, further comprising:

a reset element, wherein:

the reset element is a spring, when the rotating element moves from a lower step to a higher step, the reset element restores elastic force, and when the rotating element moves from the higher step to the lower step, the reset element releases the elastic force to drive the guiding element and the water reversing element to move and reset in the direction away from the outlet cover plate.

12. The outlet device configured to switch between different outlet water types according to claim 10, further comprising:

a reset element, wherein:

the reset element is a spring, the reset element is connected to the water reversing element and is disposed with a second plurality of steps disposed along the rotating direction of the rotating element, p2 the reset element and the first plurality of steps of the guiding element are symmetrically opposite to each other to define a moving passage for the abutting block, the abutting block is disposed in the moving passage, when the abutting block moves from a lower step to a higher step, a force abutting the abutting block drives the water reversing element to move in the direction toward the outlet cover plate, and when the abutting block moves from the higher step to the lower step, the force abutting the reset element drives the water reversing element to move in the direction away from the outlet cover plate.

13. The outlet device configured to switch between different outlet water types according to claim 10, further comprising:

an operation element, wherein:

the operation element is a button, the operation element drives a ratchet wheel-ratchet mechanism to rotate intermittently, and the rotating element comprises a rotational shaft connected to a ratchet wheel of the ratchet wheel-ratchet mechanism.

14. The outlet device configured to switch between different outlet water types according to claim 13, wherein:

the button disposed at a body of a shower head, and when the button is pressed:

the button pushes a pendulum block to swing, a first end of the pendulum block abuts the button, and a second end of the pendulum block abuts a ratchet of the ratchet wheel-ratchet mechanism.

* * * * *